US011091333B2

(12) United States Patent
Slovencik

(10) Patent No.: US 11,091,333 B2
(45) Date of Patent: Aug. 17, 2021

(54) DEVICE FOR PROVIDING A THREE-DIMENSIONAL CUSHIONING MATERIAL FOR CUSHIONING AN EMPTY VOLUME IN A TRANSPORT CONTAINER

(71) Applicant: Storopack Hans Reichenecker GMBH, Metzingen (DE)

(72) Inventor: Jean-Marc Slovencik, Uhrwiller (FR)

(73) Assignee: Storopack Hans Reichenecker GMBH, Metzingen (DE)

( * ) Notice: Subject to any disclaimer, the term of this patent is extended or adjusted under 35 U.S.C. 154(b) by 0 days.

(21) Appl. No.: 16/979,289

(22) PCT Filed: Jan. 18, 2019

(86) PCT No.: PCT/EP2019/051267

§ 371 (c)(1),
(2) Date: Sep. 9, 2020

(87) PCT Pub. No.: WO2019/170311

PCT Pub. Date: Sep. 12, 2019

(65) Prior Publication Data

US 2021/0001586 A1 Jan. 7, 2021

(30) Foreign Application Priority Data

Mar. 9, 2018 (DE) ..... 10 2018 105 435.1

(51) Int. Cl.
*B65H 1/04* (2006.01)
*B31D 1/00* (2017.01)
(Continued)

(52) U.S. Cl.
CPC ..... *B65H 1/04* (2013.01); *B31D 1/0043* (2013.01); *B31D 5/0043* (2013.01); *B65H 1/266* (2013.01);
(Continued)

(58) Field of Classification Search
CPC ... B65H 1/00; B65H 1/04; B65H 1/26; B65H 1/266; B65H 2301/11; B65H 2301/5122;
(Continued)

(56) References Cited

U.S. PATENT DOCUMENTS 5,483,889 A * 1/1996 Hoberock ..... B65H 1/04 101/232
2003/0216236 A1* 11/2003 Harding ..... B31D 5/0047 493/350
(Continued)

FOREIGN PATENT DOCUMENTS

DE 102016114342 A1 2/2018
JP 58157645 A * 9/1983 ..... B65H 1/04
(Continued)

OTHER PUBLICATIONS

PCT/EP2019/051267, International Search Report dated Apr. 17, 2019, Translation.
(Continued)

*Primary Examiner* — Prasad V Gokhale
(74) *Attorney, Agent, or Firm* — Wood Herron & Evans LLP

(57) ABSTRACT

The invention relates to a device for providing a three-dimensional cushioning material for cushioning an void volume in a transport container, comprising a converting apparatus for converting a flat web-like starting material into the three-dimensional cushioning material and a receiving means for receiving at least regions of a stack of the web-like starting material folded in a zigzagging manner. The receiving means has a first lateral contact means for a first stack type, which has a first width (B1), and a second lateral contact means for a second stack type, which has a second width (B2), such that either a stack of the first stack type or a stack of the second stack type can be arranged in
(Continued)

the receiving means in a centered manner relative to the same central axis.

10 Claims, 6 Drawing Sheets

(51) Int. Cl.

| | |
|---|---|
| ***B31D 5/00*** | (2017.01) |
| ***B65H 1/26*** | (2006.01) |
| ***B65H 20/02*** | (2006.01) |
| ***B65H 29/16*** | (2006.01) |

(52) U.S. Cl.
CPC ..... *B65H 20/02* (2013.01); *B65H 29/16* (2013.01); *B65H 2301/11* (2013.01); *B65H 2301/5122* (2013.01); *B65H 2405/1142* (2013.01); *B65H 2405/312* (2013.01); *B65H 2701/11218* (2013.01); *B65H 2701/11231* (2013.01); *B65H 2701/50* (2013.01)

(58) Field of Classification Search
CPC ..... B65H 2405/114; B65H 2405/1142; B65H 2405/312; B65H 2405/332; B65H 2701/11218; B65H 2701/11231; B65H 2701/50; B31D 1/0043; B31D 5/0043; B31D 5/0047; B31D 5/0052; B31D 5/0056; B31D 5/006; B31D 5/0069; B31D 2205/0005; B31D 2205/0011; B31D 2205/0017; B31D 2205/0035
See application file for complete search history.

(56) References Cited

U.S. PATENT DOCUMENTS

| | | | | |
|---|---|---|---|---|
| 2015/0014205 | A1* | 1/2015 | Yap ..... | B65D 85/07 206/494 |
| 2016/0200065 | A1 | 7/2016 | Cheich et al. | |
| 2017/0259522 | A1 | 9/2017 | Cheich et al. | |

FOREIGN PATENT DOCUMENTS

| | | | | |
|---|---|---|---|---|
| JP | 60082538 | A * | 5/1985 | ..... B65H 1/04 |
| WO | 2011100078 | A2 | 8/2011 | |

OTHER PUBLICATIONS

DE10 2018 105 435.1, German Examination Report, dated Jan. 21, 2019.
PCT/EP2019/051267, International Preliminary Report on Patentability, dated Feb. 21, 2020.
PCT/EP2019/051267, Written Opinion.

* cited by examiner

DEVICE FOR PROVIDING A THREE-DIMENSIONAL CUSHIONING MATERIAL FOR CUSHIONING AN EMPTY VOLUME IN A TRANSPORT CONTAINER

The invention relates to a device for providing a three-dimensional cushioning material for cushioning a void volume in a transport container according to the preamble of claim 1.

For example, DE 10 2016 114 342 A1 discloses a device for providing a three-dimensional cushioning material which fills a void volume of a transport container, and thus the objects present in the transport container can be cushioned and protected against slipping and damage. For this purpose, a web-like and in this respect to a large extent two-dimensional starting material is provided, for example a paper web, which can, for example, be removed from a stack. The web-like starting material is converted into the three-dimensional cushioning material in a converting apparatus designed as a crumpling apparatus.

The problem addressed by the present invention is that of providing a device of the type mentioned at the outset that can be used in a particularly flexible manner.

This problem is solved by a device having the features of claim 1. Advantageous developments are specified in dependent claims. In addition, features which are essential for the invention are found in the following description and in the accompanying drawings. These features may be essential for the invention both alone and in different combinations, without being explicitly referred to again.

The device according to the invention for providing a three-dimensional cushioning material for cushioning a void volume in a transport container comprises a converting apparatus for converting a flat web-like starting material into the three-dimensional cushioning material. The three-dimensional cushioning material is therefore preferably produced on-site by means of the device according to the invention. The flat web-like starting material used for this purpose, for example a paper web, requires little space since it is substantially two-dimensional, i.e. very thin.

The device includes a receiving means for receiving at least regions of a stack of the web-like starting material folded in a zigzagging manner. A stack of this kind can be handled very easily and can be stored very compactly and easily due to the rectangular base area, in contrast to a starting material wound on a roll. The web-like starting material can, for example, be stored or delivered in a conventional rectangular cardboard box, and the stack of the web-like starting material can be simply received in the cardboard box which is open at the top in the receiving means. In principle, however, it is also conceivable that the stack is received in the receiving means without such a cardboard box.

The web-like starting material can have material weakenings, for example in the form of perforations, extending in the transverse direction with respect to its longitudinal extension by means of which the lengths of the three-dimensional cushioning material that can be produced are predetermined. Material weakenings of this kind make it easier to separate the cushioning material. However, they are not mandatory.

According to the invention, the receiving means comprises a first lateral contact means for a first stack type, which has a first width, and a second lateral contact means for a second stack type, which has a second width, such that either a stack of the first stack type or a stack of the second stack type can be arranged in the receiving means in a centered manner relative to a same central axis.

In order to reliably feed the web-like starting material into the converting apparatus and thus for the device as a whole to function reliably, it is important for the web-like starting material to be positioned in the center, as seen in the lateral direction, relative to a feed of the converting apparatus. Owing to the design of the receiving means according to the invention, this is also ensured when a stack of the web-like starting material having a first width is received in the receiving means in a first operating situation, and a stack of the web-like starting material having a second width is received in the receiving means in a second operating situation.

This is achieved by providing different lateral contact means on the receiving means, each of which is designed for a very specific width of a stack and the corresponding stack type. For a stack type having a comparatively large width, the corresponding lateral contact means is arranged laterally relatively far from a central axis of the feed of the converting apparatus and the receiving means, whereas, for a stack type having a comparatively small width, the corresponding lateral contact means is arranged laterally and relatively close to the central axis. In this case, the lateral contact means are always present and are fixed or stationary, and therefore no adjustment work to the lateral contact means has to be performed by an operator when changing from one stack type to another stack type.

In this way, the device according to the invention can be used for starting materials of different widths, so that three-dimensional cushioning materials having different widths and thus having different cushioning properties can be produced, depending on which stack type is currently received in the receiving means. The device according to the invention is thus very flexible. This increased flexibility is achieved in a simple manner, and therefore the device according to the invention can furthermore be comparatively inexpensive. It should be pointed out here that the receiving means can, of course, also be designed for more than two different stack types, for example for three or four different stack types. The only requirement is that a corresponding number of lateral contact means is then also provided.

In a first development, the first lateral contact means, when viewed in a horizontal depth direction (i.e. in the direction of the central axis), can be arranged at a different location to the second lateral contact means. This means that the first stack type, when viewed in the horizontal depth direction, is received at a different location in the receiving means to the second stack type. This is structurally easy to implement.

Alternatively, or in addition, it is possible for the first lateral contact means, when viewed in a vertical height direction, to be arranged at a different location to the second lateral contact means. In this case, the first stack type, when viewed in the vertical height direction, would be received at a different location in the receiving means to the second stack type. This is also structurally easy to implement.

It is simple and therefore inexpensive if at least regions of the receiving means are made from a bent sheet metal. Moreover, a sheet metal of this kind creates a flat lateral contact means, which allows easy positioning of the relevant stack.

It is also possible for the first lateral contact means to have two contact portions arranged opposite one another and at a distance corresponding to the first width. In this way, at least regions of the first stack type are received between two lateral contact means, as a result of which said stack type is reliably centered relative to the central axis and is secured against slipping.

Similarly, it is also possible for the second lateral contact means to have two contact portions arranged opposite one another and at a distance corresponding to the second width.

It is particularly advantageous if the receiving means is arranged on a carrier which can be moved on rollers and which can be laterally connected to a carrier of the converting apparatus by means of a connecting means in a centered manner relative to the converting apparatus. This makes it possible, for example, to provide two separate receiving means on respective carriers, which are constructed identically but are equipped with different stack types. Depending on which type of cushioning material is currently desired, either the one receiving means or the other receiving means can then be moved on the relevant carrier thereof toward the converting apparatus and connected to the carrier of the converting apparatus.

At least one of the lateral contact means, when viewed in a horizontal depth direction, can also have a smaller extension than the stack type to be centered by this contact means. Thus, when the stack is received in the receiving means, part of the lateral edge of the stack remains uncovered by the contact means, which facilitates the insertion and handling of the stack in the receiving means.

These advantages also apply if at least one of the lateral contact means, when viewed in a vertical height direction, has a smaller extension than the stack type to be centered by this contact means.

The receiving means provided according to the invention is particularly advantageous when the device comprises a converting unit for reverting at least one side edge of the web-like starting material in the direction of a center of the starting material, as a result of which an intermediate product is formed, and a crumpling mechanism for crumpling the intermediate product into the three-dimensional cushioning material.

Subsequently, embodiments of the invention will be explained with reference to the accompanying drawings. Functionally equivalent elements and regions have the same reference numbers in all figures. In the drawings.

Figure 1:
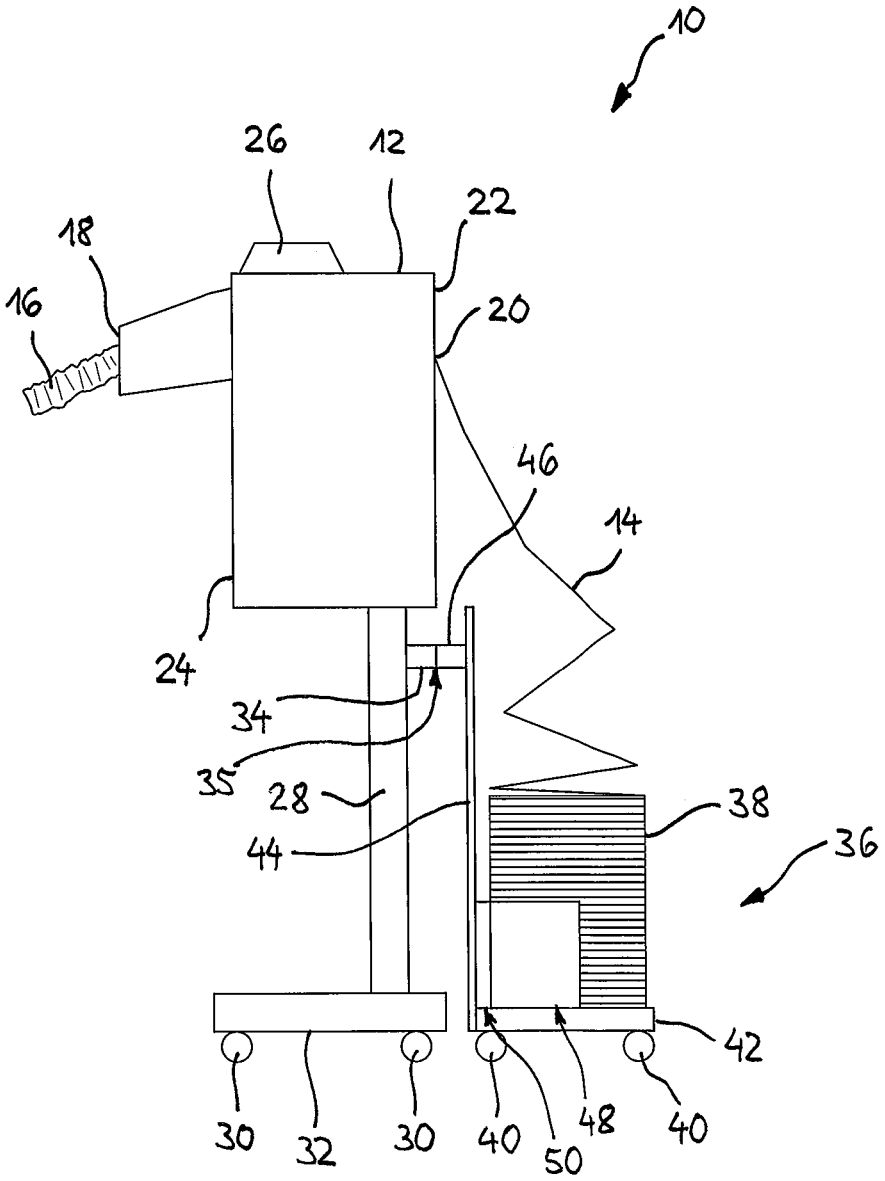
FIG. 1 is a schematic lateral view of a device for providing a three-dimensional cushioning material, comprising a first embodiment of a receiving means for a web-like starting material.

A device for providing a three-dimensional cushioning material for cushioning a void volume in a transport container, overall, has the reference number 10 in FIG. 1. It comprises a converting apparatus, represented overall by a box 12, for converting a flat web-like starting material 14 into the three-dimensional cushioning material 16. The converting apparatus 12, when viewed in the direction of the production sequence, initially comprises a converting unit (not shown) for reverting the two side edges of the web-like starting material 14, as a result of which an intermediate product is produced. Said intermediate product is fed to a crumpling mechanism (also not shown) which is also part of the converting apparatus 12, which crumpling mechanism crumples the intermediate product by means of axial compression and thus converts it into the three-dimensional cushioning material 16 which is ultimately provided at an outlet 18.

The web-like starting material 14 enters the converting apparatus 12 through a feed 20 on a rear side 22 of the converting apparatus 12. The outlet 18, at which the cushioning material 16 is provided, is, in contrast, arranged on a front side 24 of the converting apparatus 12. There is an operating unit 26 above the converting apparatus 12, by means of which an operator can, for example, set a crumpling factor, i.e. the extent of the axial compression, and a length of the cushioning material 16 to be produced, as well as further operating variables, for example a speed at which the starting material 14 is fed into the converting apparatus 12 and the cushioning material 16 is produced.

The converting apparatus 12 is arranged on a vertically extending carrier 28 which, in turn, is arranged on a carrier 32 which can move on rollers 30 and is substantially designed as a horizontal plate or as a horizontal frame. Just below the converting apparatus 12, a first portion 34 of a connecting means 35 is arranged on the vertical carrier 28.

The device 10 further includes a receiving means 36 which can receive at least regions of a stack 38 of the web-like starting material 14 folded in a zigzagging manner. As can be seen from FIG. 1, by way of example, the stack 38 is received "naked" in the receiving means 36, i.e. without a container that surrounds at least regions thereof. In principle, however, it is also conceivable for the stack 38 to be received, for example, in a rectangular cardboard box which is open at the top and which is inserted as a whole in the receiving means 36.

In the present case, the receiving means 36 is arranged, by way of example, on a carrier 42 which can move on rollers 40 and is designed as a substantially horizontal plate or as a horizontal frame, on the edge of which carrier, which edge points toward the carrier 32 of the converting apparatus 12 in the operating position, a carrier 44 is arranged that extends vertically and is, for example, rod-shaped. Attached to said carrier 44 is a second portion 46 of the connecting means 35, which portion 46 is complementary to the above-mentioned first portion 34 and allows an easily detachable connection of the receiving means 36 to the converting apparatus 12 in a defined lateral position, specifically in a laterally centered manner relative to the converting apparatus 12.

As will be explained in more detail below, the receiving means 36 has a first lateral contact means 48 for a first type of stack 38 and a second lateral contact means 50 for a second type of stack 38, the first type of stack 38 having a first width and the second type of stack 38 having a second width, as will also be explained in more detail below. The width is the extension of the stack 38 which extends perpendicular to the sheet plane in FIG. 1.

Figure 2:
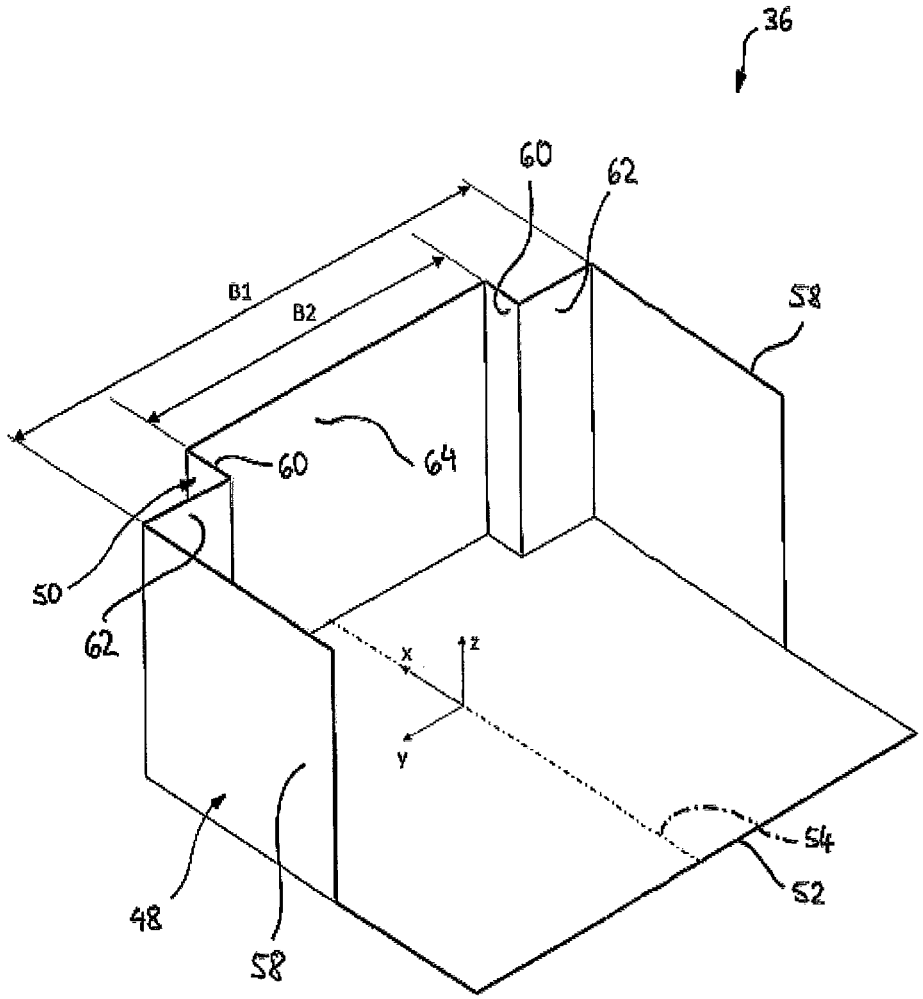
FIG. 2 is a perspective view of the receiving means of FIG. 1.

The receiving means 36 of FIG. 1 will now be explained in more detail with reference to FIGS. 2 and 3: the receiving means 36 has a horizontal base plate 52 which, overall, has a rectangular basic shape in plan view, the central axis of which base plate, which extends in an x-direction (horizontal depth direction), is shown as a dash-dotted line and has the reference number 54. The aforementioned contact means 48 and 50, which are lateral (y-direction) and in a vertical plane (spanned by the x-axis and a z-axis), extend upward from said base plate.

The first contact means 48 is formed by two lateral vertical first plate portions 58, which form first contact portions in a manner to be shown and are arranged opposite one another and at a distance B1 from one another. The second lateral contact means 50 is likewise formed by two lateral vertical second plate portions 60, which likewise form second contact portions in a manner to be shown and are arranged opposite one another and at a distance B2 from one another.

The first contact portions 58 are at the same distance of B1/2 from the central axis 54, when viewed in the lateral y-direction, and the second contact portions 60 are also at the same distance of B2/2 from the central axis 54, when viewed in the lateral y-direction. The rear edge of a first contact portion 58, as viewed in the x-direction, is connected to a front edge of the adjacent second contact portion 60, as viewed in the x-direction, by a vertically extending plate portion 62 located in a yz-plane. In addition, the rear edges of the second contact portions 60, as viewed in the x-direction, are connected to one another by a vertically extending plate portion 64 which is also located in a yz-plane.

In this way, the contact portions 58 and 60 and the plate portions 62 and 64 form a continuous vertical rear and lateral wall of the receiving means 36, which is constructed symmetrically with respect to the central axis 54 and the yz-plane which passes through said wall, and which is produced, for example, from sheet metal bent at a right angle and, for example, is placed on the base plate 52 and welded thereto. It can also be seen that the first lateral contact means 48 is arranged such that the first contact portions 58 are further forward in the horizontal depth direction (x-axis), and the second lateral contact means 50 is arranged such that the second contact portions 60 are further to the rear in the horizontal depth direction (x-axis); the two contact means 48 and 50 are thus arranged at different locations in the horizontal depth direction (x-axis).

Figure 3:
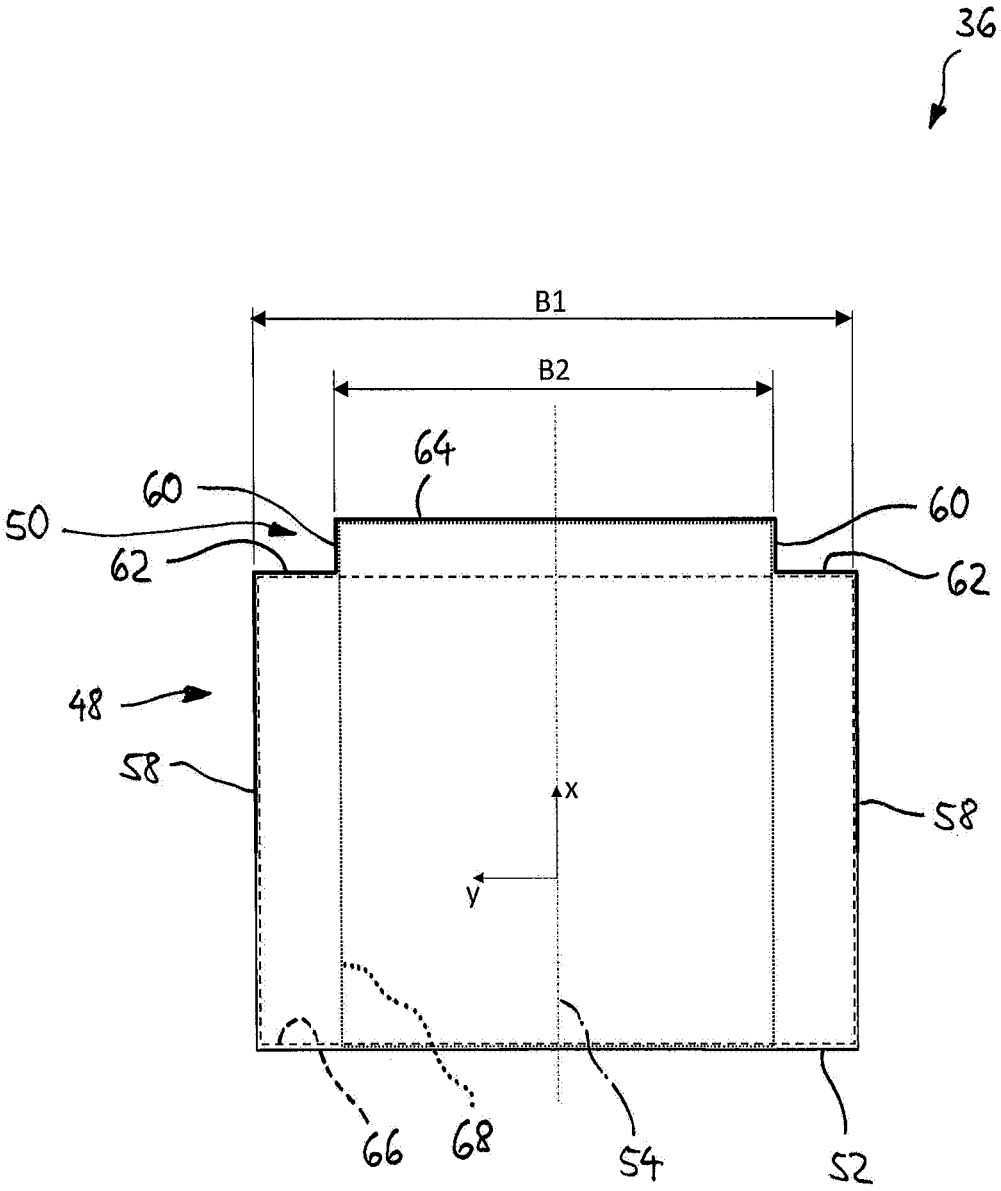
FIG. 3 is a plan view of the receiving means of FIG. 1.

As can be seen from FIG. 3, this design of the receiving means 36 creates two receiving regions 66 and 68 having a rectangular outline, the first receiving region 66 being indicated by a dashed rectangle, whereas the second receiving region 68 is indicated by a dotted rectangle. The first receiving region 66 is delimited in the horizontal depth direction (x-direction) by the plate portions 62 and in the lateral direction (y-direction) by the first lateral contact portions 58. The second receiving region 68 is delimited in the horizontal depth direction (x-direction) by the plate portion 64 and in the lateral direction (y-direction) by the second lateral contact portions 60. Each receiving region 66 and 68 is used to receive a stack 38 of starting material 14 of a stack type having the corresponding width B1 or B2.

Figure 4:
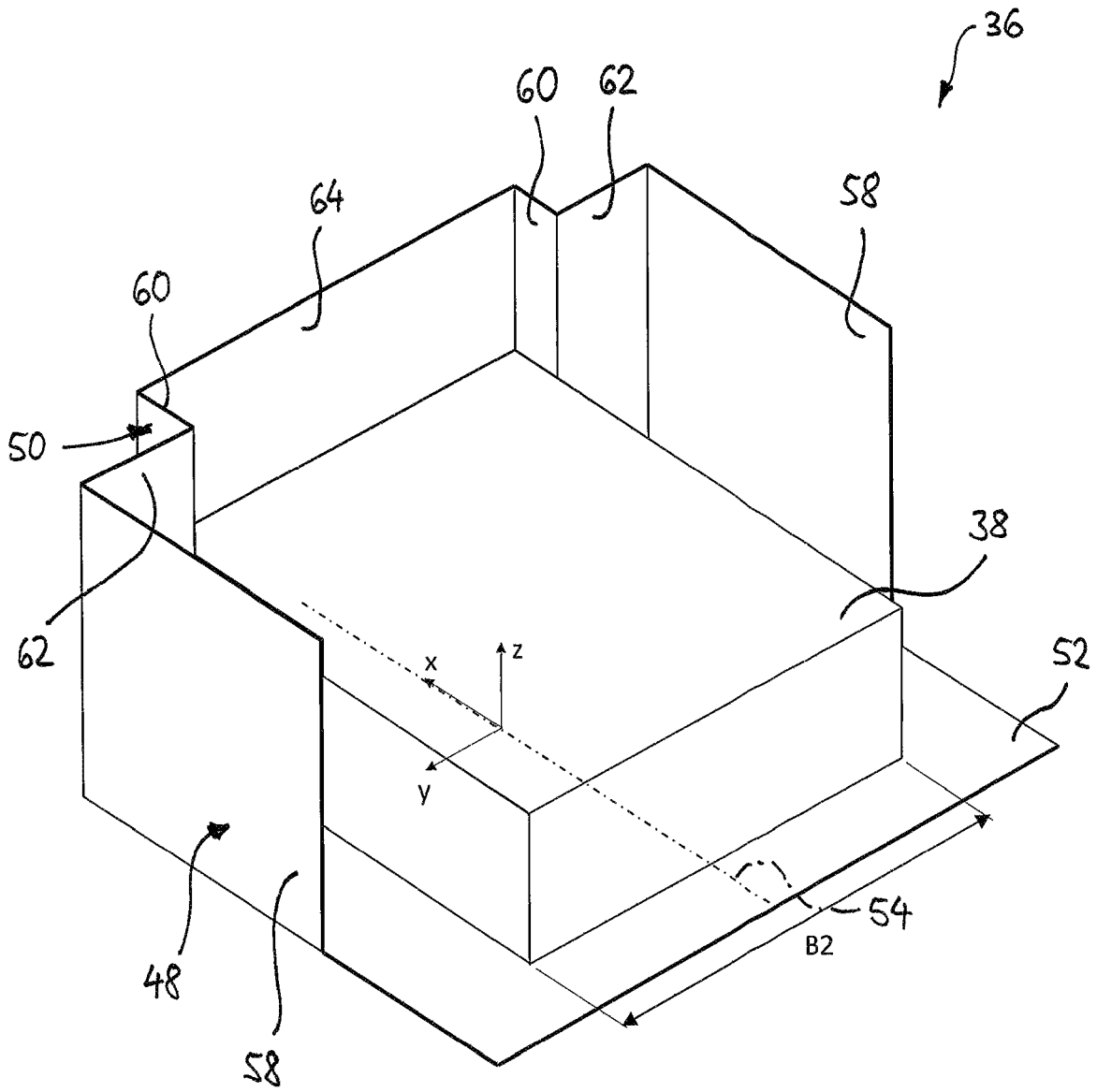
FIG. 4 is a perspective view of the receiving means of FIG. 1 having an inserted first stack type.

Accordingly, an operating situation is shown in FIG. 4, in which a stack 38 of a second stack type having a width B2 is received in the second receiving region 68. It can easily be seen that this stack 38 is arranged in a centered manner relative to the central axis 54 by means of the second lateral contact means 50 having the second lateral contact portions 60.

Figure 5:
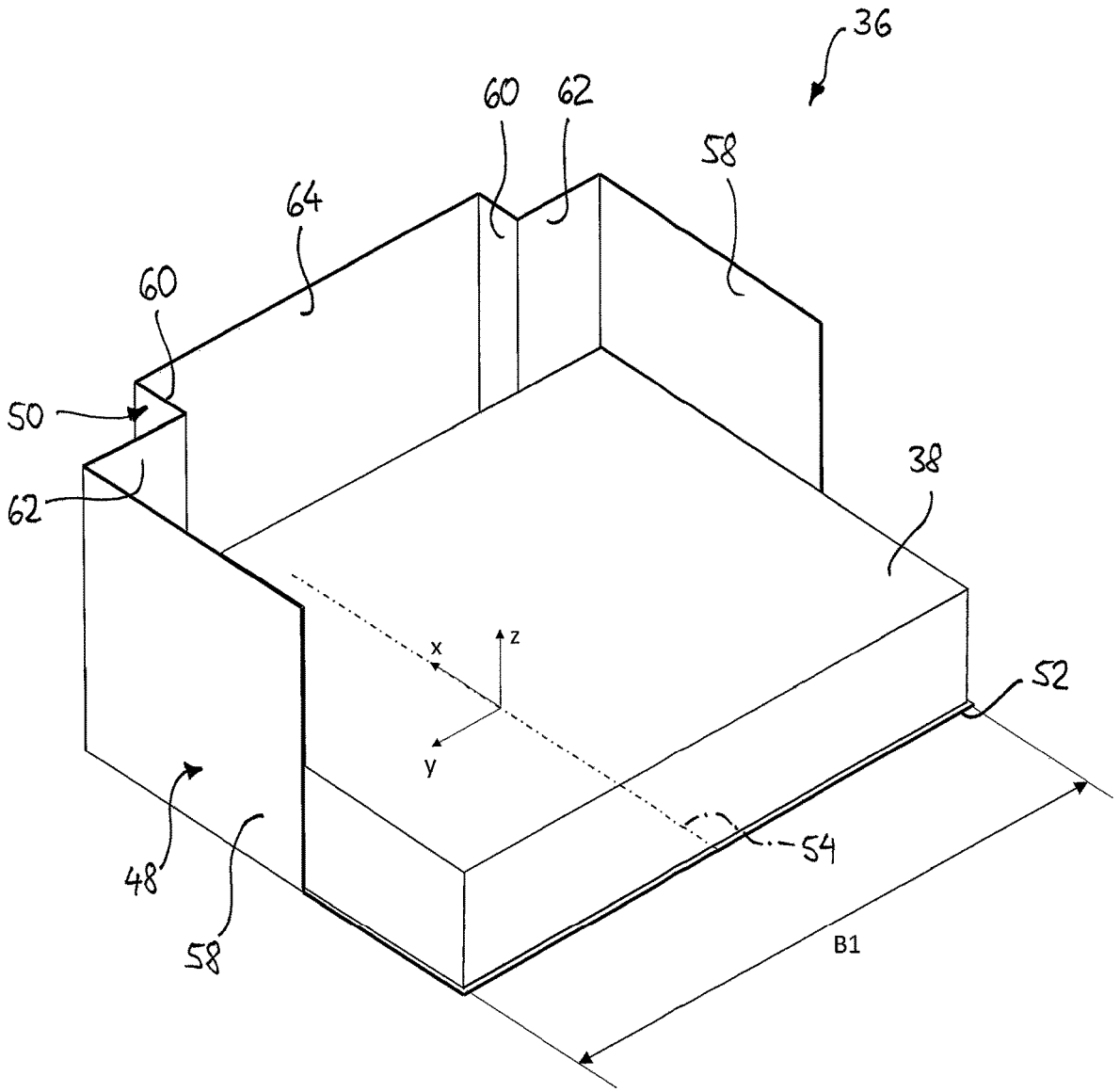
FIG. 5 is a perspective view of the receiving means of FIG. 1 having an inserted second stack type.

FIG. 5 shows another operating situation in which a stack 38 of a first stack type having a width B1 is received in the first receiving region 66. The width B1 is larger than the width B2. Here, too, it can easily be seen that this stack 38 is also arranged in a centered manner relative to the same central axis 54 by means of the first lateral contact means 48 having the first lateral contact portions 58.

It can also be seen from both FIGS. 4 and 5 that the two lateral contact means 48 and 50, or their contact portions 58 and 60, have a smaller extension in the direction of the horizontal depth direction (x-direction) than the stacks 38. In this way, a lateral edge (without reference number) of the relevant stack 38 remains free, which facilitates the insertion of the corresponding stack 38 in the receiving means 36.

The height of the two stacks 38 in FIGS. 4 and 5 is drawn relatively low in the present case, in order to prevent the respective stacks 38 from covering the rear regions of the receiving means 36, as viewed in the x-direction. At least initially, however, the stacks 38 have a greater height which projects beyond the upper edges of the contact portions 58 and 60 and of the plate portions 62 and 64. At least initially, the lateral contact means 48 and 50, when viewed in the vertical height direction (z-direction), have a smaller extension than the relevant stack 38 to be centered by said contact means 48 and 50.

Figure 6:
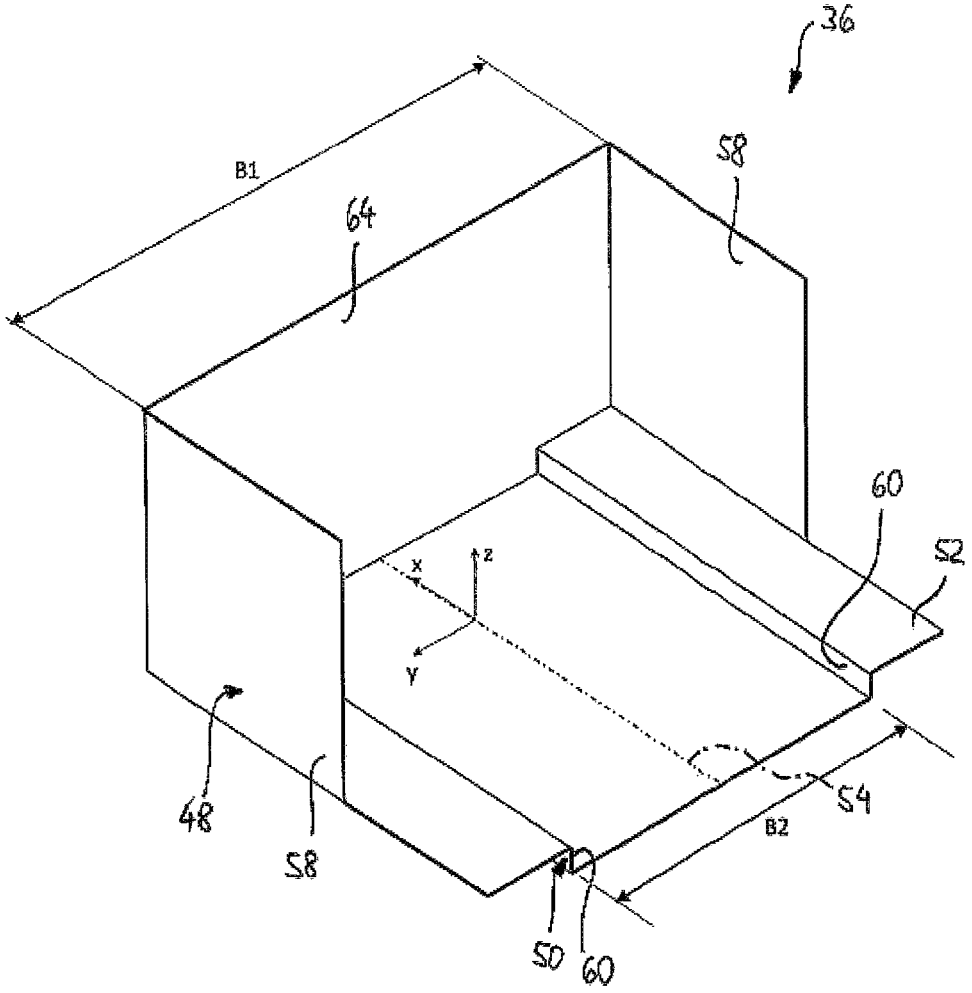
FIG. 6 is a perspective view of a second embodiment of a receiving means.

A second embodiment of the receiving means 36 will now be explained with reference to FIG. 6. In this embodiment, it is not only the lateral boundary which is produced by folded sheet metal, but also the base plate 52. In this way, the first lateral contact means 48 is formed, similarly to the previous embodiment, by the lateral first contact portions 58 which extend vertically upward from the base plate 52. The lateral second contact portions 60 of the second contact means 50 are, by contrast, formed by the stepped surfaces produced by the folding of the base plate 52. In this embodiment, the first lateral contact means 48 is therefore arranged in the vertical height direction (z-direction) at a different (higher) location to the second lateral contact means 50.

The invention claimed is:

1. Device for providing a three-dimensional cushioning material for cushioning a void volume in a transport container, comprising a converting apparatus for converting a flat web starting material into the three-dimensional cushioning material and a receiving means for receiving at least regions of a stack of the web starting material folded in a zigzagging manner wherein the receiving means comprises a first lateral, fixed and stationary, respectively, contact means for a first stack type which has a first width, and a second lateral, fixed and stationary, respectively, contact means for a second stack type which has a second width which is different from the first width, such that either a stack of the first stack type or a stack of the second stack type can be arranged in the receiving means in a centered manner relative to the same central axis.

2. Device according to claim 1, wherein the first lateral contact means, when viewed in a horizontal depth direction, is arranged at a different location to the second lateral contact means.

3. Device according to claim 1, wherein the first lateral contact means, when viewed in a vertical height direction, is arranged at a different location to the second lateral contact means.

4. Device according to claim 1, wherein at least regions of the receiving means are produced from bent sheet metal.

5. Device according to claim 1, wherein the first lateral contact means has two contact portions arranged opposite one another and at a distance corresponding to the first width.

6. Device according to at claim 1, wherein the second lateral contact means has two contact portions arranged opposite one another and at a distance corresponding to the second width.

7. Device according to claim 1, wherein the receiving means is arranged on a carrier which can be moved on rollers and which can be laterally connected to a carrier of the converting apparatus by means of a connecting means in a centered manner relative to the converting apparatus.

8. Device according to claim 1, wherein at least one of the lateral contact means, when viewed in a horizontal depth direction, has a smaller extension than the stack to be centered by said at least one of the lateral contact means.

9. Device according to claim 1, wherein at least one of the lateral contact means, when viewed in a vertical height direction, has a smaller extension than the stack to be centered by said at least one of the lateral contact means.

10. Device according to claim 1, wherein the converting apparatus comprises a converting unit for reverting at least one side edge of the web starting material toward a center of the starting material, as a result of which an intermediate product is produced, and a crumpling mechanism for crumpling the intermediate product into the three-dimensional cushioning material.

* * * * *